US006306527B1

(12) United States Patent
Ikeda et al.

(10) Patent No.: US 6,306,527 B1
(45) Date of Patent: Oct. 23, 2001

(54) HOT-DIP GALVANIZED STEEL SHEET AND PROCESS FOR PRODUCTION THEREOF

(75) Inventors: Shushi Ikeda; Koichi Makii; Yosuke Shindo, all of Kobe; Shunichi Hashimoto; Takahiro Kashima, both of Kakogawa; Hiroshi Akamizu; Masahiro Nomura, both of Kobe, all of (JP)

(73) Assignee: Kabushiki Kaisha Kobe Seiko Sho, Kobe (JP)

( * ) Notice: Subject to any disclaimer, the term of this patent is extended or adjusted under 35 U.S.C. 154(b) by 0 days.

(21) Appl. No.: 09/685,096

(22) Filed: Oct. 11, 2000

(30) Foreign Application Priority Data

Nov. 19, 1999 (JP) ..... 11-329145
May 23, 2000 (JP) ..... 12-150856

(51) Int. Cl.[7] ..... B32B 15/18; B05D 1/18

(52) U.S. Cl. ..... 428/659; 148/533; 427/433; 427/436; 428/939

(58) Field of Search ..... 428/659, 939; 427/433, 436; 148/533

(56) References Cited

FOREIGN PATENT DOCUMENTS 55-122821 9/1980 (JP) .
58-39770 3/1983 (JP) .
4-26744 1/1992 (JP) .
4-128320 4/1992 (JP) .
4-128321 4/1992 (JP) .
4-173945 6/1992 (JP) .
5-331537 12/1993 (JP) .
8-134591-A * 5/1996 (JP) ..... C22C/38/00
9-25537 1/1997 (JP) .
9-263883 10/1997 (JP) .

* cited by examiner

*Primary Examiner*—Robert R. Koehler
(74) *Attorney, Agent, or Firm*—Oblon, Spivak, McClelland, Maier & Neustadt, P.C.

(57) ABSTRACT

A hot-dip galvanized steel sheet which is produced from a cold-rolled steel sheet, as a base steel sheet, consisting essentially of C: 0.010–0.06 wt %, Si: no more than 0.5 wt %, Mn: no less than 0.5 wt % and less than 2.0 wt %, P: no more than 0.20 wt %, S: no more than 0.01 wt %, Al: 0.005–0.10 wt %, N: no more than 0.005 wt %, Cr: no more than 1.0 wt %, Mn+1.3Cr: 1.9–2.3 wt %, Fe: remainder, and having a structure composed of ferrite and a second phase containing martensite, said second phase in the structure accounting for no more than 20% in terms of area and martensite in the second phase accounting for no less than 50%, and which has a zinc-plated layer formed on the surface thereof by hot-dip galvanizing or hot-dip galvannealing. A process for production of said hot-dip galvanized steel sheet. This steel sheet has a composite structure containing martensite and yet it has a low strength (no higher than 500 MPa) and also has good strength-ductility balance.

6 Claims, 1 Drawing Sheet

HOT-DIP GALVANIZED STEEL SHEET AND PROCESS FOR PRODUCTION THEREOF

BACKGROUND OF THE INVENTION

1. Field of the Invention

The present invention relates to a hot-dip galvanized steel sheet (including a hot-dip galvannealed steel sheet) superior in strength-ductility balance, with low strength and high ductility. The present invention relates also to a process for producing said hot-dip galvanized steel sheet.

2. Description of the Related Art

Automotive steel sheets often require both good press-workability and good corrosion resistance. Steel sheets meeting this requirement include hot-dip galvanized steel sheets and hot-dip galvannealed steel sheets. The latter are produced from cold-rolled steel sheets by hot-dip galvanization and ensuing alloying (heating at about 550° C.) to improve adhesion between the zinc plating layer and the base steel sheet. In this specification, the term "hot-dip galvanized steel sheets" covers hot-dip galvannealed steel sheets.

OBJECT AND SUMMARY OF THE INVENTION

Hot-dip galvanized steel sheets designed for high strength are sometimes produced from base steel sheets with a composite structure containing martensite and bainite in addition to ferrite. For example, Japanese Patent Laid-open No. 39770/1983 discloses a steel sheet with a three-phase structure containing ferrite, martensite, and bainite. Japanese Patent Laid-open No. 122821/1980 discloses a hot-dip galvanized steel sheet produced from a steel sheet with a two-phase structure containing ferrite and martensite. These steel sheets with a composite structure have a low yield ratio despite high strength and hence they are superior in shape freezing property.

Unfortunately, the steel sheet with a composite structure gives hot-dip galvanized steel sheets containing a large amount of martensite and bainite, with strength exceeding 500 MPa, mostly exceeding 600 MPa. The steel sheet with such properties poses a problem when formed by a press for mild steel sheets; it needs a special press for high-strength steel sheets.

The present invention was completed to address the problem mentioned above. It is an object of the present invention to provide a hot-dip galvanized steel sheet (including a hot-dip galvannealed steel sheet) superior in ductility, having a good strength-ductility balance (TS*El), with strength lower than 500 MPa, despite its composite structure containing martensite.

The first aspect of the present invention resides in a hot-dip galvanized steel sheet which is produced from a cold-rolled steel sheet, as a base steel sheet, consisting essentially of:

C: 0.010–0.06 wt %,

Si: no more than 0.5 wt %,

Mn: no less than 0.5 wt % and less than 2.0 wt %,

P: no more than 0.20 wt %,

S: no more than 0.01 wt %,

Al: 0.005–0.10 wt %,

N: no more than 0.005 wt %,

Cr: no more than 1.0 wt %,

Mn +1.3Cr: 1.9–2.3 wt %,

Fe: remainder and having a structure composed of ferrite and a second phase containing martensite, said second phase in the structure accounting for no more than 20% in terms of area and martensite in the second phase accounting for no less than 50% (in terms of area), and which has a zinc-plated layer formed on the surface thereof by hot-dip galvanizing or hot-dip galvannealing.

The cold-rolled steel sheet (as the base steel sheet) should preferably have a structure in which the second phase accounts for no more than 10% (in terms of area) and martensite in the second phase accounts for no less than 90% (in terms of area).

The second aspect of the present invention resides in a process for producing a hot-dip galvanized steel sheet, said process comprising the steps of heating, for recrystallization annealing, a cold-rolled steel sheet having the chemical composition shown in the first aspect to a temperature at which two phases of ferrite and austenite coexists, cooling it from the annealing temperature to the plating temperature at a first cooling rate of 1–10° C./s, performing hot-dip galvanizing, and finally cooling, said steps being accomplished by using a continuous annealing-plate line. This process may be modified such that the first cooling is carried out at a first cooling rate of 1–3° C./s and the second cooling is carried out at a second cooling rate no smaller than 10° C./s. The result of this modification is that the ratio of the second phase in the structure decreases to 10% or less (in terms of area) and the ratio of martensite in the second phase increases to 90% or more (in terms of area). The process may be modified further such that the hot-dip galvanizing step is followed by an alloying step and subsequently cooling is carried out at a second cooling rate greater than 10° C./s.

DESCRIPTION OF THE PREFERRED EMBODIMENTS

Figure 1:
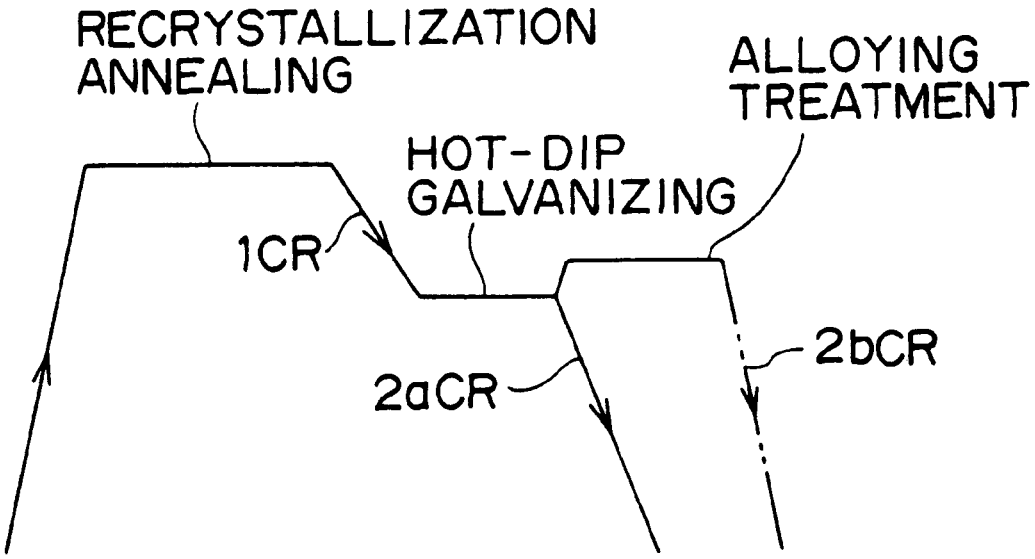
FIG. 1 is a diagrammatic representation of heat treatment involved in the production of the hot-dip galvanized steel sheet according to the present invention.

The present invention employs a cold-rolled steel sheet with a composite structure as a base steel sheet. Nevertheless, the resulting hot-dip galvanized steel sheet has a strength lower than 500 MPa and a good strength-ductility balance (greater than about 17000 MPa*%) although it has a composite structure containing martensite. This was achieved by controlling the amount of martensite in the second phase. Incidentally, the second phase embraces any phase other than ferrite; it contains bainite and/or pearlite in addition to martensite. It is hard to distinguish between bainite and pearlite; they manifest themselves in a structure containing rod-like or spherical carbide (mainly cementite).

The hot-dip galvanized steel sheet of the present invention is one which is produced from a cold-rolled steel sheet, as a base steel sheet, consisting essentially of:

C: 0.010–0.06 wt %,

Si: no more than 0.5 wt %,

Mn: no less than 0.5 wt % and less than 2.0 wt %,

P: no more than 0.20 wt %,

S: no more than 0.01 wt %,

Al: 0.005–0.10 wt %,

N: no more than 0.005 wt %,

Cr: no more than 1.0 wt %,

Mn+1.3Cr: 1.9–2.3 wt %,

Fe: remainder and having a structure composed of ferrite and a second phase containing martensite, said second phase in the structure accounting for no more than 20% in terms of area and martensite in the second phase accounting for no less than 50% (in terms of area), and which has a zinc-plated layer formed of the surface thereof by hot-dip galvanizing or hot-dip galvannealing. "Mn+1.3Cr" denotes the sum of the amount (wt %) of Mn and the amount (wt %) of Cr times 1.3.

According to the present invention, the cold-rolled steel sheet as a base steel sheet should contain the specific components in restricted amounts (in wt %) for the reasons given below.

C: 0.010–0.06 wt %,

The amount of C should be as small as possible for improved press-workability. However, a steel sheet with a C content lower than 0.010 wt % presents difficulties in commercial production because the two-phase region of ferrite+austenite is narrow and martensite is not readily formed from austenite. On the other hand, a steel sheet with a C content in excess of 0.06 wt % has such a high strength that it loses the good press-workability characteristic of mild steel sheets. The lower limit of the C content should be 0.010 wt %, preferably 0.015 wt %, and more preferably 0.020 wt %. The upper limit of the C content should be 0.06 wt %, preferably 0.04 wt %.

Si: no more than 0.5 wt %

Si is responsible for solid-solution strengthening and hence improves the steel sheet in strength. On the other hand, it reduces ductility. Si in an excess amount adversely affects adhesion of plated zinc. The upper limit of the Si content should be 0.5 wt %, preferably 0.2 wt %.

Mn: no less than 0.5 wt % and less than 2.0 wt %

Mn is responsible for improvement in hardenability. An amount less than 0.5 wt % is not enough to improve hardenability and to form martensite. A steel sheet with such a small Mn content is poor in hot-workability. An Mn content exceeding 2.0 wt % has an adverse effect on adhesion of plated layer and causes defective plating. Therefore, the content of Mn should be no less than 0.5 wt %, preferably no less than 0.8 wt %, but less than 2.0 wt %, preferably less than 1.8 wt %.

P: no more than 0.20 wt %

P is a cheap element responsible for solid-solution strengthening. For the steel sheet of the present invention which needs ductility rather than strength, the amount of P should be no more than 0.20 wt %, preferably no more than 0.10 wt %.

S: no more than 0.01 wt %

S forms sulfide precipitates (mainly MnS), deteriorating ductility. The amount of S should be no more than 0.01 wt %, preferably no more than 0.006 wt %. (The less, the better).

Al: 0.005–0.10 wt %

Al functions as a deoxidizing agent. It should be added in an amount of at least 0.005 wt %. Al in an excess amount does not heighten its effect but forms aluminum inclusions which deteriorate ductility and cause clogging to the continuous casting nozzle (which lowers productivity). The upper limit of Al content should be 0.10 wt %.

N: no more than 0.005 wt %

As the content of N increases, it is necessary to add a larger amount of element to form nitrides (or fix nitrogen), which increases production cost and deteriorates ductility. The present invention requires that the content of N should be as small as possible. The upper limit of N content should be 0.005 wt %, preferably 0.003 wt %.

Cr: no more than 1.0 wt %

Cr functions similarly to Mn in improving hardenability. Cr is less effective in solid-solution strengthening and hence it is suitable for such low-strength DP steel as in the present invention. The content of Cr should preferably be no less than 0.3 wt %. Cr in an amount exceeding 1.0 wt % forms $Cr_7Ca$ which deteriorates ductility. Therefore, the content of Cr should be no more than 1.0 wt %, preferably no more than 0.7 wt %.

Mn +1.3Cr: 1.9–2.3 wt %

"Mn+1.3Cr" is an index to denote hardenability. A value smaller than 1.9 wt % indicates that the steel is poor in hardenability and deficient in martensite. A value greater than 2.3 wt % indicates that the steel is poor in platability. Consequently, "Mn+1.3Cr" should be within the range from an lower limit of 1.9 wt %, preferably 2.1 wt %, to an upper limit of 2.3 wt %, preferably 2.2 wt %.

The base cold-rolled steel sheet to be made into the hot-dip galvanized steel sheet of the present invention is composed of the above-mentioned primary components and Fe (as the remainder) and inevitable impurities. It may contain other elements to improve its characteristic properties and other elements not detrimental to the functions of the primary elements.

The base cold-rolled steel sheet has a structure composed of ferrite and a second phase (bainite and/or pearlite in addition to martensite). The ratio (in terms of area) of said second phase in the structure should be no more than 20%, preferably no more than 15%, and more preferably no more than 10%. With a ratio in excess of 20%, the steel sheet has high strength and is poor in press-workability. The ratio (in terms of area) of martensite in said second phase should be no less than 50%, preferably no less than 80%, more preferably no less than 85%. With a ratio of bainite or pearlite exceeding 50% in said second phase, the steel sheet has a high yield strength (yield ratio) because of the decreased density of movable dislocations introduced into ferrite.

The amount of each structure is measured (in terms of area ratio) by observation under a microscope. The structure composed of the components according to the present invention is such that it is difficult to distinguish between bainite and pearlite and other phases than ferrite and martensite manifest themselves in the phase containing rod-like or spherical carbides.

The components and structure specified above are responsible for the steel having a strength lower than 500 MPa, improved ductility [in terms of strength-ductility balance (TS×El) greater than about 17000 (MPa·%)], and a low yield ratio leading to good shape-freezing property. This effect is remarkable particularly in the case where said second phase accounts for no more than 10% in the entire structure and martensite in said second phase accounts for no less than 90%. In such a case, the steel sheet has good ductility (more than about 39%) and good strength-ductility balance (greater than about 17000 MPa·%) and also has a decreased yield ratio (lower than about 50%) even though it has a strength no higher than 500 MPa. Therefore, the steel sheet exhibits good press-workability even when processed by a press for mild steel sheets.

According to the present invention, the hot-dip galvanized steel sheet is produced as follows from a cold-rolled steel sheet having the above-mentioned chemical composition. The process starts with heating for recrystallization annealing in a continuous annealing-plating line up to a temperature at which two phases of ferrite and austenite coexist. This heating step is followed by slow cooling to a plating temperature at a first cooling rate of 1–10° C./s, preferably 1–3° C./s. At this plating temperature, hot-dip galvanizing is carried out. The plated steel sheet is cooled at a second cooling rate preferably no smaller than 10° C./s, although it may be allowed to cool slowly. If the hot-dip galvanized layer undergoes alloying treatment, the galvanizing should preferably be followed by rapid cooling at a second cooling rate greater than 10° C./s.

The above-mentioned cold-rolled steel sheet is produced from a steel slab of the above-mentioned composition by hot rolling and cold rolling in the usual way. The condition of hot rolling is not specifically restricted, but the heating temperature of the slab should preferably be about 1100–1250° C. The finishing temperature of hot rolling should be higher than $Ar_3$ point, and the winding temperature should be about 400–700° C. at which the structure of ferrite+pearlite or ferrite+bainite is obtained. At a winding temperature higher than 600° C., the structure of ferrite+pearlite will dominate in the hot-rolled steel sheet. At a winding temperature lower than 600° C., the structure of ferrite+bainite will dominate in the hot-rolled steel sheet. Hot rolling is followed by pickling and cold rolling with a draft greater than about 40%, preferably greater than 50%.

After recrystallization annealing in a continuous annealing-plating line, the cold-rolled steel sheet undergoes hot-dip galvanizing as shown in FIG. 1. The recrystallization annealing should be carried out at about 760–840° C. for the two phases of ferrite and austenite. At annealing temperature lower than 760° C., carbide in the hot-rolled steel sheet does not dissolve completely in austenite, with residual carbide decreasing ductility. On the other hand, if the annealing temperature exceeds 840° C., it is necessary to greatly reduce the first cooling rate (1CR) for cooling from the annealing temperature so that the area ratio of the second phase is smaller than 20%. Such slow cooling presents difficulties in industrial production. Preferably, the lower limit should be 780° C. and the upper limit should be 820° C. Annealing usually takes several seconds to ten-odd seconds in the case of a continuous annealing-plating line.

In the period from recrystallization annealing to dipping in the hot-dip galvanizing bath, the steel sheet is cooled at a first cooling rate (1CR) no smaller than 1° C./s and no greater than 10° C./s. This cooling rate is important in the present invention. Cooling at a rate smaller than 1° C./s results in pearlite transformation which leads to deficiency in ferrite and martensite and deteriorates strength-ductility balance. On the other hand, cooling at a rate greater than 10° C./s does not delay the bainite transformation which occurs when the C concentrations in austenite increases as the result of ferrite formation. This ends up with an increase in the amount of the second phase and the amount of bainite in the second phase, which deteriorates ductility. Therefore, the 1CR should be no smaller than 1° C./S and no greater than 10° C./s, preferably no greater than 6° C./s. In order for the second phase accounts for no more than 10% of the entire structure, it is desirable that 1CR should be no smaller than 1° C./s and no greater than 3° C./s. This cooling rate should be properly controlled according to the thickness of the steel sheet after annealing.

Hot-dip galvanizing is usually accomplished at a plating temperature of 400–480° C. by dipping in a hot-dip galvanizing bath. After plating, the galvanized steel sheet is allowed to cool if the plating layer is not annealed. The second cooling rate (2aCR) after plating is not specifically restricted because the pearlite transformation hardly occurs during cooling from the plating temperature. However, rapid cooling at a rate (2aCR) no smaller than 10° C./s prevents more effectively the transformation of austenite into pearlite and bainite. The result is a remarkable increase in the amount of martensite in the second phase, which improves ductility more. For the amount of martensite in the second phase to no less than 90%, it is necessary to keep 2aCR no smaller than 10° C./s, preferably no smaller than 30° C./s. A cooling rate no smaller than 10° C./s may be obtained by forced cooling, transfer by air-cooled rolls, or mist cooling. The upper limit of the second cooling rate is not specifically restricted but, in actual, it depends on the capacity of the cooling unit.

In the case where the galvanized layer is annealed afterward, the plated steel sheet is heated at about 500–700° C. for several seconds to ten-odd seconds. At a temperature lower than 500° C., alloying treatment takes a long time, which is unfavorable for industrial production. At a temperature higher than 700° C., alloying treatment proceeds excessively, which poses a problem with powdering at the time of press forming. A desirable temperature is about 550–600° C.

Alloying treatment is followed by cooling at a second cooling rate (2bCR) no smaller than 10° C./s, preferably no smaller than 30° C./s. Slow cooling at a second cooling rate (2bCR) smaller than 10° C./s causes austenite to change into pearlite and bainite, thereby increasing the amount of pearlite and bainite in the second phase and hence deteriorating ductility. If the base cold-rolled steel sheet contains the second phase in a small amount no more than 10%, it is possible to increase the amount of martensite in the second phase to 90% and above by raising 2bCR to 25° C./s and above, preferably 30° C./s and above.

The present invention will be described in more detail with reference to the following examples, which are not intended to restrict the scope thereof.

EXAMPLE

A steel of the chemical composition as shown in Table 1 below was prepared by using a vacuum induction furnace. A slab of the steel was heated to 1150° C. and then hot-rolled such that the finishing temperature was 850° C. The rolled steel sheet was wound at 560–680° C. After pickling, the steel sheet underwent cold rolling at a draft of 60%. Thus there was obtained a cold-rolled steel sheet, 1.2 mm thick. This cold-rolled steel sheet underwent recrystallization annealing by a continuous annealing plating line at 800° C. for 60 seconds. The annealed steel sheet was cooled from 800° C. at a cooling rate (1CR ° C./s) as shown in Table 2. Then the cooled steel sheet underwent hot-dip galvanizing (temperature of plating bath: 460° C., duration of dipping: 20 seconds). After plating, samples Nos. 15–28 were allowed to cool (at 2aCR=4° C./s) or cooled by misting (at 2aCR=10–30° C./s). After plating, samples Nos. 1 to 14 and 29 underwent alloying treatment at 550° C. for 15 seconds. Then they were allowed to cool (at 2bCR =4° C./s) or cooled by misting (at 2bCR=30° C./s).

From the thus obtained samples were taken specimens for tensile test (conforming to JIS No. 5). The specimens were examined for microstructure and mechanical properties. With the plating layer removed, the specimen was etched with nital solution and the etched surface was observed under a scanning electron microscope (×1000). The area ratio of the second phase (composed of martensite+bainite or martensite+pearlite) was determined by image analysis. Then, the specimen was etched with lepera solution and the etched surface was observed under an optical microscope (×1000). The amount of martensite was determined by image analysis. The surface of the specimen was visually observed to evaluate platability. Specimens are rated as poor in platability if they have unplated spots through which base steel is visible. Mechanical properties were examined by testing method conforming to JIS No. 2241. The results are shown in Table 2.

TABLE 1

| Steel | Chemical composition (wt %, with remainder being substantially Fe) C | Si | Mn | P | S | Al | N | Cr | Mn + 1.3Cr | Note |
|---|---|---|---|---|---|---|---|---|---|---|
| A | 0.07 | 0.02 | 1.5 | 0.02 | 0.005 | 0.05 | 0.004 | 0.5 | 2.15 | |
| B | 0.06 | 0.02 | 1.5 | 0.02 | 0.005 | 0.05 | 0.004 | 0.5 | 2.15 | ○ |
| C | 0.04 | 0.02 | 1.5 | 0.02 | 0.005 | 0.05 | 0.004 | 0.5 | 2.15 | ○ |
| D | 0.020 | 0.02 | 1.5 | 0.02 | 0.005 | 0.05 | 0.004 | 0.5 | 2.15 | ○ |
| E | 0.015 | 0.02 | 1.5 | 0.02 | 0.005 | 0.05 | 0.004 | 0.5 | 2.15 | ○ |
| F | 0.04 | 0.02 | 1.0 | 0.02 | 0.005 | 0.05 | 0.004 | 0.9 | 2.17 | ○ |
| G | 0.04 | 0.02 | 0.5 | 0.02 | 0.005 | 0.05 | 0.004 | 1.3 | 2.13 | |
| H | 0.04 | 0.02 | 1.2 | 0.02 | 0.005 | 0.05 | 0.004 | 0.5 | 1.85 | |
| I | 0.04 | 0.02 | 2.0 | 0.02 | 0.005 | 0.05 | 0.004 | 0.3 | 2.39 | |
| J | 0.04 | 0.02 | 0.5 | 0.02 | 0.005 | 0.05 | 0.004 | 1.1 | 1.93 | |
| K | 0.07 | 0.02 | 1.5 | 0.02 | 0.005 | 0.05 | 0.004 | 0.5 | 2.15 | |
| L | 0.06 | 0.02 | 1.5 | 0.02 | 0.005 | 0.05 | 0.004 | 0.5 | 2.15 | ○ |
| M | 0.04 | 0.02 | 1.5 | 0.02 | 0.005 | 0.05 | 0.004 | 0.5 | 2.15 | ○ |
| N | 0.020 | 0.02 | 1.5 | 0.02 | 0.005 | 0.05 | 0.004 | 0.5 | 2.15 | ○ |
| O | 0.015 | 0.02 | 1.5 | 0.02 | 0.005 | 0.05 | 0.004 | 0.5 | 2.15 | ○ |
| P | 0.04 | 0.02 | 1.0 | 0.02 | 0.005 | 0.05 | 0.004 | 0.9 | 2.17 | ○ |
| Q | 0.04 | 0.02 | 0.5 | 0.02 | 0.005 | 0.05 | 0.004 | 1.3 | 2.13 | |
| R | 0.04 | 0.02 | 1.2 | 0.02 | 0.005 | 0.05 | 0.004 | 0.5 | 1.85 | |
| S | 0.04 | 0.02 | 2.0 | 0.02 | 0.005 | 0.05 | 0.004 | 0.3 | 2.39 | |
| T | 0.04 | 0.02 | 0.5 | 0.02 | 0.005 | 0.05 | 0.004 | 1.1 | 1.93 | |
| U | 0.03 | 0.02 | 1.5 | 0.02 | 0.005 | 0.05 | 0.004 | 0.5 | 2.15 | ○ |

○: Steels according to the present invention.

the highest. These values suggest that they are superior in ductility and press-workability.

Sample Nos. 16, 17, 19–21, 26–28, which were produced from the steels designated as B–F, L–P, and U (having the chemical composition according to the present invention) and which were hot-dip galvanized such that annealing was followed by slow cooling at a cooling rate (1CR) smaller than 10° C./s.

Sample Nos. 2, 3, 8–10, 29, which are hot-dip galvannealed steel sheets produced by cooling at a cooling rate (2bCR) larger than 10° C./s.

Of these samples, Nos. 26–29 are characterized by the decreased amount of the second phase (that is, the second phase area is reduced to 10% or less) and the increased amount of martensite in the second phase (that is, the amount of martensite in the second phase is increased to 90%). Therefore, they have an elongation value larger than 39% and a yield ratio smaller than 50%. This suggests that they are superior in press-workability.

[Effect of the Invention]

The hot-dip galvanized steel sheet of the present invention has low strength (less than 500 MPa), good strength-ductility balance, and a low yield ratio despite its composite structure containing martensite. Therefore, it is superior in ductility and press-workability. The process of the present invention includes the step of recrystallization annealing which is followed by cooling at a first cooling rate of 1–10° C./s and also includes, for the production of hot-dip galvannealed steel sheet, the additional step of alloying treatment which is followed by cooling at a rate no smaller than 10° C./s. The procedure in this manner decreases the amount of the second phase containing martensite and increases the amount of martensite in the second phase. Therefore, the

TABLE 2

| Sample | Steel | 1CR ° C./s | 2aCR ° C./s | 2bCR ° C./s | Area of 2nd phase (%) | M in 2nd phase (%) | Mechanical properties YS MPa | TS MPa | EI % | YR % | TS*EI MPa* % | Note |
|---|---|---|---|---|---|---|---|---|---|---|---|---|
| 1 | A | 4 | — | 30 | 22 | 80 | 257 | 515 | 33.5 | 50 | 17253 | C.E. |
| 2 | B | 4 | — | 30 | 18 | 80 | 246 | 492 | 35.0 | 50 | 17220 | |
| 3 | C | 4 | — | 30 | 15 | 80 | 234 | 482 | 35.5 | 49 | 17111 | |
| 4 | C | 4 | — | 4 | 15 | 5 | 310 | 476 | 33.5 | 65 | 15946 | C.E. |
| 5 | C | 12 | — | 30 | 18 | 30 | 298 | 465 | 33.5 | 64 | 15578 | C.E. |
| 6 | C | 30 | — | 30 | 25 | 15 | 287 | 478 | 33.0 | 60 | 15774 | C.E. |
| 7 | C | 0.5 | — | 30 | 15 | 3 | 340 | 458 | 32.0 | 74 | 14656 | C.E. |
| 8 | D | 4 | — | 30 | 15 | 80 | 228 | 451 | 38.5 | 51 | 17364 | |
| 9 | E | 4 | — | 30 | 10 | 85 | 222 | 441 | 38.5 | 50 | 16978 | |
| 10 | F | 4 | — | 30 | 15 | 80 | 238 | 466 | 37.3 | 51 | 17382 | |
| 11 | G | 4 | — | 30 | 10 | 5 | 224 | 462 | 30.5 | 48 | 14091 | C.E. |
| 12 | H | 4 | — | 30 | 15 | 35 | 347 | 465 | 34.0 | 75 | 14810 | C.E. |
| 13 | I | 4 | — | 30 | 20 | 85 | 239 | 491 | 35.0 | 49 | 17185 | C.E. |
| 14 | J | 4 | — | 30 | 15 | 30 | 320 | 422 | 34.0 | 76 | 14348 | C.E. |
| 15 | K | 4 | 4 | — | 25 | 85 | 262 | 510 | 34.0 | 51 | 17340 | C.E. |
| 16 | L | 4 | 4 | — | 20 | 85 | 256 | 484 | 35.4 | 53 | 17134 | |
| 17 | M | 4 | 4 | — | 15 | 85 | 239 | 472 | 36.5 | 51 | 17228 | |
| 18 | M | 30 | 4 | — | 25 | 20 | 295 | 473 | 33.5 | 62 | 15846 | C.E. |
| 19 | N | 4 | 4 | — | 15 | 85 | 235 | 446 | 38.7 | 53 | 17260 | |
| 20 | O | 4 | 4 | — | 10 | 85 | 227 | 437 | 39.0 | 52 | 17043 | |
| 21 | P | 4 | 4 | — | 15 | 85 | 245 | 460 | 38.0 | 53 | 17480 | |
| 22 | Q | 4 | 4 | — | 10 | 15 | 235 | 460 | 37.5 | 51 | 14490 | C.E. |
| 23 | R | 4 | 4 | — | 15 | 40 | 352 | 450 | 35.0 | 77 | 16030 | C.E. |
| 24 | S | 4 | 4 | — | 20 | 85 | 249 | 487 | 35.5 | 51 | 17289 | C.E. |
| 25 | T | 4 | 4 | — | 15 | 40 | 325 | 416 | 34.0 | 78 | 14144 | C.E. |
| 26 | U | 3 | 10 | — | 6 | 90 | 221 | 446 | 39.3 | 50 | 17509 | |
| 27 | C | 3 | 20 | — | 8 | 95 | 222 | 458 | 39.3 | 48 | 18001 | |
| 28 | D | 2 | 30 | — | 3 | 100 | 207 | 436 | 39.7 | 47 | 17319 | |
| 29 | C | 3 | — | 30 | 8 | 90 | 220 | 442 | 39.0 | 50 | 17238 | |

M: Area of martensite (%)
C.E.: Comparative Example

It is noted from Table 2 that all of the following samples (according to the present invention) are characterized by that the second phase accounts for less than 20% of the entire structure and the amount of martensite in the second phase accounts for more than 80%, and are also characterized by strength lower than 500 MPa and strength-ductility balance greater than 17000 MPa*%, with yield ratio being 53% at process of the present invention permits easy production of hot-dip galvanized steel sheets superior in ductility.

What is claimed is:

1. A hot-dip galvanized steel sheet which is produced from a cold-rolled steel sheet, as a base steel sheet, consisting essentially of:

C: 0.010–0.06 wt %,

Si: no more than 0.5 wt %,

Mn: no less than 0.5 wt % and less than 2.0 wt %,

P: no more than 0.20 wt %,

S: no more than 0.01 wt %,

Al: 0.005–0.10 wt %,

N: no more than 0.005 wt %,

Cr no more than 1.0 wt %,

Mn+1.3Cr: 1.9–2.3 wt %,

Fe: remainder and having a structure composed of ferrite and a second phase containing martensite, said second phase in the structure accounting for no more than 20% in terms of area and martensite in the second phase accounting for no less than 50% (in terms of area), and which has a zinc-plated layer formed on the surface thereof by hot-dip galvanizing or hot-dip galvannealing.

2. A hot-dip galvanized steel sheet as defined in claim 1, wherein the structure is such that the second phase accounts for no more than 10% in terms of area and martensite in the second phase accounts for no less than 90% (in terms of area).

3. A hot-dip galvanized steel sheet as defined in claim 1, which has a hot-dip galvannealed layer formed thereon.

4. A process for producing a hot-dip galvanized steel sheet, said process comprising the steps of heating, for recrystallization annealing, a cold-rolled steel sheet having the chemical composition shown in claim 1 to a temperature at which two phases of ferrite and austenite coexists, cooling it from the annealing temperature to the plating temperature at a first cooling rate of 1–10° C./s, performing hot-dip galvanizing, and finally cooling, said steps being accomplished by using a continuous annealing-plating line.

5. A process for producing a hot-dip galvanized steel sheet as defined in claim 4, wherein the first cooling is carried out at a first cooling rate of 1–3° C./s and the second cooling is carried out at a second cooling rate no smaller than 10° C./s.

6. A process for producing a hot-dip galvanized steel sheet, said process comprising the steps of heating, for recrystallization annealing, a cold-rolled steel sheet having the chemical composition shown in claim 1 to a temperature at which two phases of ferrite and austenite coexists, cooling it from the annealing temperature to the plating temperature at a first cooling rate of 1–10° C./s, performing hot-dip galvanizing, further performing alloying treatment, finally cooling at a second cooling rate no smaller than 10° C./s, said steps being accomplished by using a continuous annealing-plating line.

* * * * *